US006863178B2

(12) United States Patent
Sokolsky et al.

(10) Patent No.: US 6,863,178 B2
(45) Date of Patent: Mar. 8, 2005

(54) PACKET CONTAINER

(75) Inventors: David Sokolsky, Dallas, TX (US); Jamie Sendra, Dallas, TX (US); Clarence Zierhut, Garland, TX (US)

(73) Assignee: Daisy Brand, Inc., Dallas, TX (US)

( * ) Notice: Subject to any disclaimer, the term of this patent is extended or adjusted under 35 U.S.C. 154(b) by 63 days.

(21) Appl. No.: 10/072,463

(22) Filed: Feb. 7, 2002

(65) Prior Publication Data

US 2002/0148855 A1 Oct. 17, 2002

Related U.S. Application Data

(63) Continuation-in-part of application No. 09/730,282, filed on Dec. 5, 2000, now Pat. No. 6,360,916.

(51) Int. Cl.[7] ..... B65D 21/00

(52) U.S. Cl. ..... 206/499; 206/820; 383/38; 426/115; 426/119

(58) Field of Search ..... 383/14, 32, 38; 206/449, 824, 820; 426/115, 120, 124, 119

(56) References Cited

U.S. PATENT DOCUMENTS

| | | | | | |
|---|---|---|---|---|---|
| 1,038,644 | A | * | 9/1912 | Phin | 206/459.5 |
| 2,707,581 | A | | 5/1955 | Kaplan et al. | |
| 2,793,120 | A | * | 5/1957 | Bennett | 426/79 |
| 2,978,285 | A | * | 4/1961 | Jester | 312/284 |
| 3,064,872 | A | * | 11/1962 | Skirow | 206/433 |
| 3,288,333 | A | | 11/1966 | Valk, Jr. | |
| 3,933,273 | A | | 1/1976 | Cox | 222/1 |
| 3,972,419 | A | * | 8/1976 | Short | 211/78 |
| 4,141,997 | A | * | 2/1979 | Syroka et al. | 426/79 |
| 4,377,598 | A | * | 3/1983 | Nugent | 426/108 |
| 4,491,245 | A | | 1/1985 | Jamison | 222/107 |
| 4,775,055 | A | * | 10/1988 | Morse | 211/78 |
| 4,935,283 | A | | 6/1990 | Jamison | 428/174 |
| 4,974,732 | A | | 12/1990 | Sullivan et al. | 206/610 |
| 4,988,016 | A | | 1/1991 | Hawkins et al. | 222/92 |
| 5,018,646 | A | | 5/1991 | Billman et al. | 222/107 |
| 5,047,252 | A | * | 9/1991 | Liu et al. | 426/79 |
| 5,301,835 | A | | 4/1994 | Fulks et al. | 222/95 |
| 5,323,931 | A | | 6/1994 | Robards, Jr. et al. | 222/96 |
| 5,330,074 | A | | 7/1994 | Wirsig et al. | 222/82 |
| 5,370,271 | A | | 12/1994 | Segatz | 222/95 |
| 5,370,282 | A | | 12/1994 | Sedlmeier | 222/391 |
| 5,375,740 | A | | 12/1994 | Umetsu et al. | 222/95 |
| 5,419,460 | A | | 5/1995 | Herold et al. | 222/105 |
| 5,429,273 | A | | 7/1995 | King et al. | 222/82 |
| 5,443,181 | A | | 8/1995 | Popp et al. | 222/95 |
| 5,634,572 | A | | 6/1997 | Lane, Jr. et al. | 222/95 |
| 5,650,180 | A | | 7/1997 | Kumada et al. | 425/376.1 |
| 5,664,670 | A | * | 9/1997 | Cozzie | 206/216 |
| 5,693,386 | A | * | 12/1997 | Cheng | 428/35.2 |
| 6,206,493 | B1 | * | 3/2001 | Sanchez-Levin et al. | 312/125 |
| 6,360,916 | B1 | | 3/2002 | Sokolsky et al. | 222/107 |

* cited by examiner

*Primary Examiner*—Jila M. Mohandesi
(74) *Attorney, Agent, or Firm*—Gardere Wynne Sewell, LLP

(57) ABSTRACT

An arrangement of individual condiment serving packets in an outer container is provided having an approximately cylindrical container with at least four dual-packet sheets within said container.

Each dual-packet sheet has a pair of individual condiment-filled packets each having a condiment-filled portion, said packets having a weakened tear-line in an unfilled medial portion of the sheet between them for manual separation of said packets for individual use. The dual-packet sheets are arranged with their condiment-filled portions in opposed front-to-back contact with their medial portions in parallel alignment and pinched closely together or in contact so that the condiment-filled portions are arranged generally like spokes on a wheel sized so as to fit into said approximately cylindrical container and to be thereby maintained in said approximately circular arrangement by said outer approximately cylindrical container.

14 Claims, 8 Drawing Sheets

PACKET CONTAINER

This application is a continuation-in-part of U.S. patent application Ser. No. 09/730,282, filed Dec. 5, 2000, now U.S. Pat. No. 6,360,916.

BACKGROUND

The present invention relates to individual serving condiment packages and a method and apparatus for arranging and packing such individual serving condiment packages into a container.

Individual serving packets, such as those used for catsup or other condiments in fast-food restaurants, are known. Typically, such packets are formed of two opposed sheets of plastic, sealed at the edges and filled with the condiment. An example of a particularly functional individual serving packets is described in U.S. patent application Ser. No. 09/730,282, co-invented by the present inventors and assigned to the present assignee. The disclosure of this application is incorporated herein by reference.

Individual serving packets are typically sold and/or shipped to the fast-food restaurant or store in larger containers. Such larger containers take a wide variety of forms, such as clear plastic bags, paper cartons, etc. The individual serving packages are packed into the larger container in a variety of manners, including parallel straight rows and sometimes in a random manner.

The prior art does not, however, adequately address the problem of how to pack a plurality of individual serving packets in a container in a manner that is easy to use, simple and efficient, and aesthetically pleasing.

OBJECT OF THE INVENTION

Accordingly, it is an object of the present invention to provide a method and apparatus for arranging and packing individual serving condiment packets into a container that overcomes the foregoing disadvantages.

SUMMARY OF THE INVENTION

This object is achieved in accordance with a preferred embodiment of the present invention, which provides an arrangement of condiment packets in a container having a top, a bottom and peripheral walls, wherein the packets are arranged generally like spokes on a wheel and are maintained in said generally spokes-in-a-wheel arrangement by said outer peripheral wall of said container.

In accordance with a preferred aspect of this embodiment, the packets are grouped together in pairs, forming dual-packet sheets. Each dual-packet sheet has a pair of individual condiment-filled packets each having a condiment-filled portion, the packets having a weakened tear-line in an unfilled medial portion of the sheet between them for manual separation of said packets for individual use. The dual-packet sheets are arranged with their condiment-filled portions in opposed front-to-back contact with their medial portions in parallel alignment and pinched closely together so that the condiment-filled portions are arranged generally like spokes on a wheel in a container having a size such that said packets are maintained in the approximately spokes-on-a-wheel arrangement by the outer peripheral wall.

This object is also achieved in accordance with a preferred aspect of this invention, wherein the outer peripheral wall is approximately cylindrical.

This object is also achieved in accordance with a preferred aspect of this invention, wherein at least a portion of said container is transparent or translucent portion so that said generally spokes-on-a-wheel arrangement of said condiment packets is visible from outside the container.

This object is also achieved in accordance with another preferred aspect of this invention, wherein the arrangement of condiment packets has a height, the lower approximately cylindrical portion having a height less than the height of the arrangement of individual condiment serving packets so that a portion of the individual condiment serving packets is retained in the upper approximately cylindrical portion.

This object is also achieved in accordance with another preferred aspect of this invention, wherein at least one of the upper and lower approximately cylindrical portions has a larger diameter at a point where the upper and lower approximately cylindrical portions meet than at their distal portions.

This object is also achieved in accordance with another preferred aspect of this invention, wherein there is an interference fit between lower portions of the packets and the lower portion of the container.

DETAILED DESCRIPTION

Figure 1:
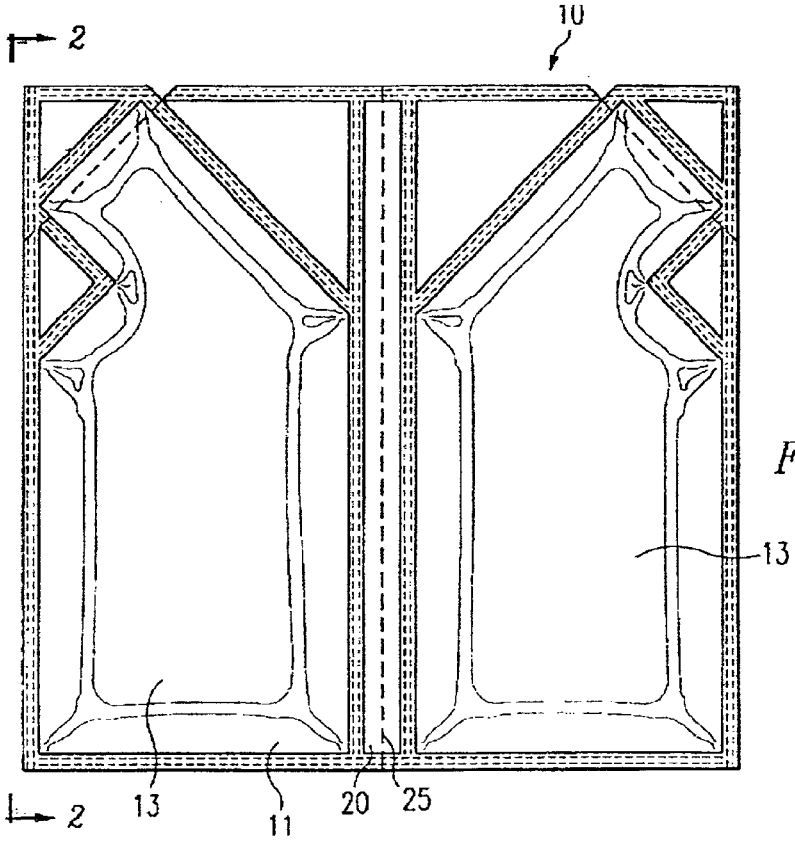
FIG. 1 is a front view of a dual-packet sheet having two condiment-filled portions separated by a medial portion suitable for use in the present invention.
Figure 2:
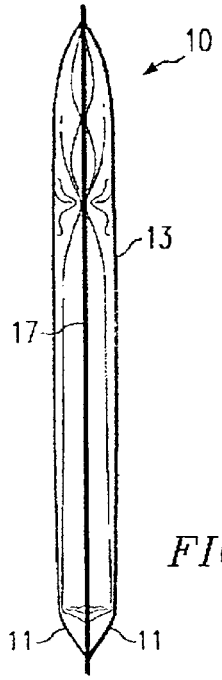
FIG. 2 is a view of the dual-packet sheet depicted in FIG. 1 along one of its long edges.

Turning now to the drawings in detail, and initially to FIGS. 1 and 2 thereof, a dual-packet sheet 10 formed by two facing plastic sheets 11, and having a pair of condiment packets 13 is depicted. Condiment packets 13 each have a condiment-filled portion 15, and an unfilled medial portion 20 between the condiment packets 13. The unfilled medial portion 20 also includes a weakened portion 25 running longitudinally down the center of the medial portion so that each of the condiment packets 13 may conveniently be separated manually from each other prior to use. The weakened portion 15 may, for example, be a score line, a perforation or a notch at the edge of the medial portion to facilitate starting a tear.

In the example embodiment of the dual-packet sheet 10 depicted in FIGS. 1 and 2, each condiment-filled portion includes a slanted nozzle portion 30 and 30', respectively, as more fully described in U.S. patent application Ser. No. 09/730,282, the contents of which are incorporated herein by reference. The condiment-containing portions 15 on dual-packet sheet 10 may be formed by sealing the two plastic facing sheets 11 forming the dual-packet sheet 10 together by means of heat, ultrasonic energy, adhesive or other means, filling the condiment-containing portions 15 with a desired amount of condiment, and sealing the fill openings.

Figure 3:
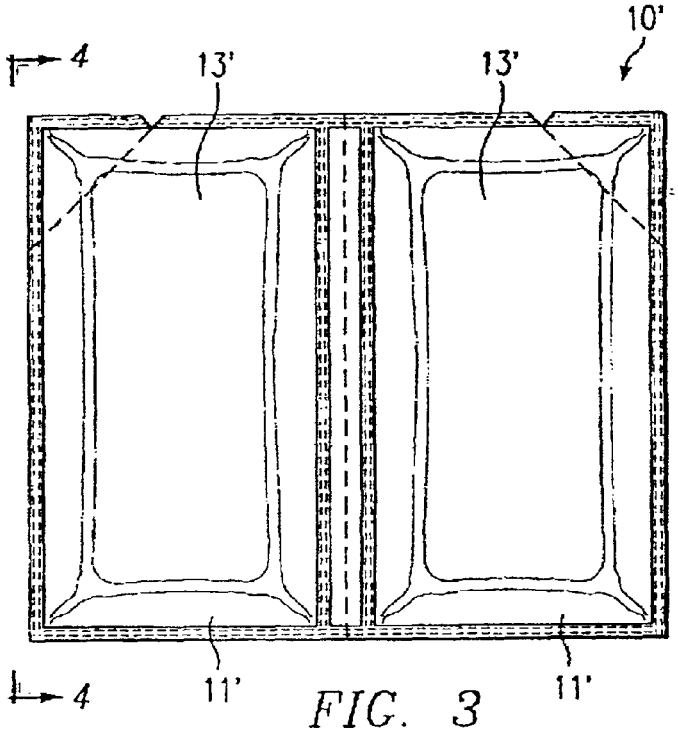
FIG. 3 is a front view of an alternative dual-packet sheet having two rectangular condiment-filled portions separated by a medial portion, suitable for use in the present invention.
Figure 4:
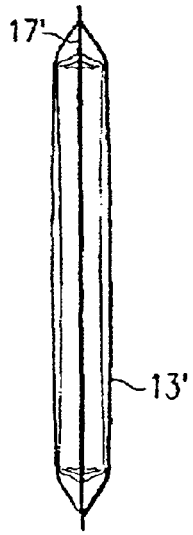
FIG. 4 is a view of the dual-packet sheet depicted in FIG. 3 along one of its long edges.

It is not required to use the specific dual-packet sheet 10 depicted in FIGS. 1 and 2, as a packet having a product containing portion of any shape will work, providing it fits into an outer container in a spokes-in-a-wheel arrangement. Turning now to FIGS. 3 and 4, another version of a dual-packet sheet 40 useful in the invention is depicted, in this case with two rectangular-shaped condiment-filled portions 45.

Figure 5:
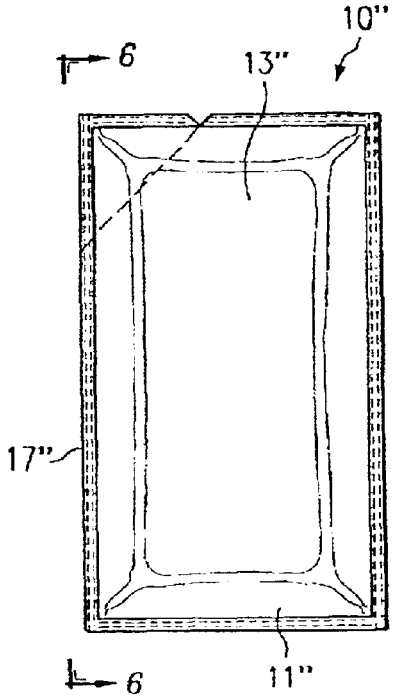
FIG. 5 is a front view of a single rectangular packet sheet.
Figure 6:
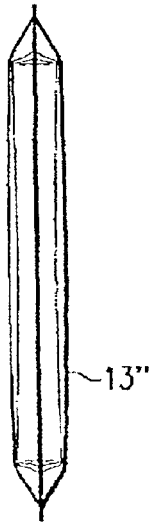
FIG. 6 is a view of the single packet depicted in FIG. 5 along one of its long edges.

Although the use of a dual-packet sheet is advantageous in the invention, a single packet, such as depicted in FIGS. 5 and 6, will also work, providing that a plurality of the packets will fit into an outer container in a spokes-in-a-wheel arrangement.

Where the perimeter of the condiment-containing portion is an asymmetrical shape, such as the embodiment depicted in FIGS. 1 and 2, it is preferable that the condiment-containing portions be arranged so that they are generally mirror-images of each other, as depicted. It is to be understood that the perimeter of the condiment-containing portions of the packets 13 may be rectangular, symmetrical, asymmetrical, triangular, oval, rounded or any other shape. For convenience, the FIGS. 1 and 2 dual-packets will be primarily discussed herein, it being understood that the same explanation applies to FIGS. 2–3 dual-packets and dual-packets of any other shape. Furthermore, with some modifications to the method of placing the packets into the outer container, the same discussion also applies to the single packets of FIGS. 5–6.

As depicted in FIG. 2, when filled, the condiment-filled portions 15 are substantially thicker than the unfilled perimeter edges 17 and the unfilled medial portion 20 of the sealed-together plastic sheets 11 forming the dual-packet sheet 10, these portions being, of course, substantially the thickness of the two plastic sheets affixed together.

Figure 7:
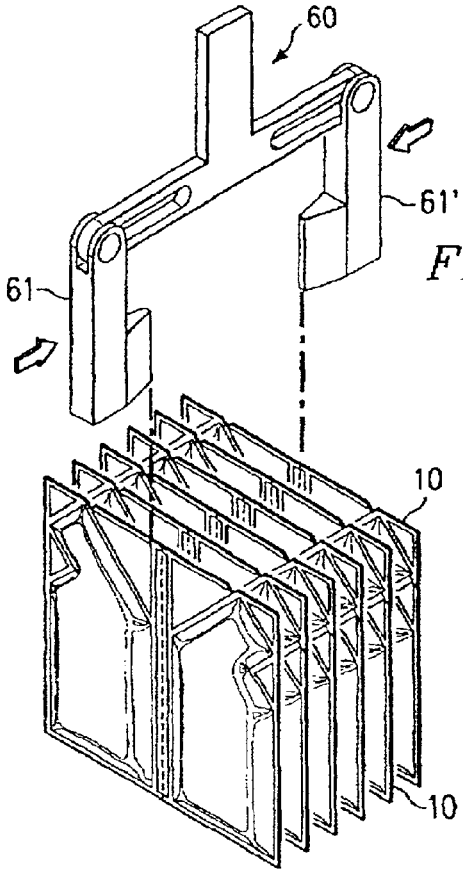
FIG. 7 is a perspective view of six of the dual-packet sheets arranged parallel and front-to-back with their medial portions in a line, prior to having the medial portions pinched together by a pinching mechanism.
Figure 8:
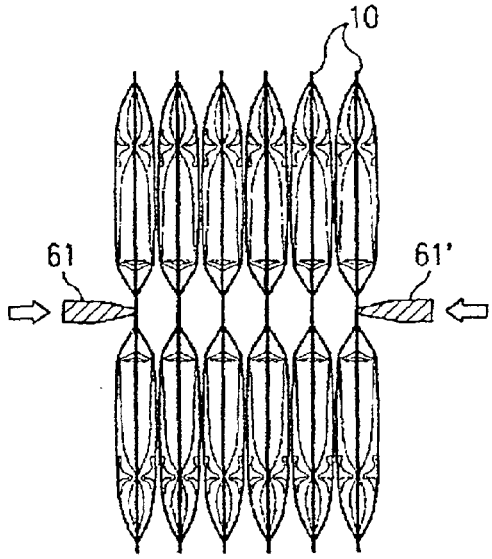
FIG. 8 is a top view of six dual-packet sheets depicted in FIG. 7.

With reference now to FIGS. 7–11, a preferred manner of placing dual-packet sheets 10 into an outer container 100 is depicted. Referring first to FIGS. 7 and 8, a front-to-back arrangement of six of the dual-packet sheets 10, as seen from above in FIG. 8 and seen in perspective in FIG. 7, are depicted with their medial portions 20 generally aligned, prior to having the medial portions 20 pinched together by means of fingers 61 and 61' of pincher mechanism 60, as further described below. Although sheets 10 are described as being front-to-back, it is to be understood that both the front and back of each of the sheets are preferably substantially the same. Further, although six dual-packet sheets are depicted, it is to be understood that a smaller or larger number may be employed. Preferably, however, the minimum number of dual-packet sheets 10 is three.

Figure 9:
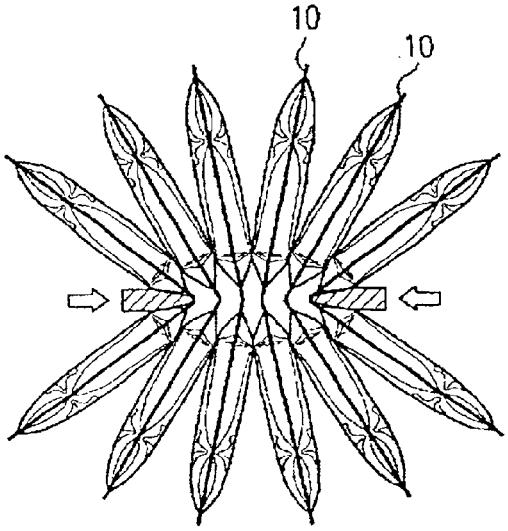
FIG. 9 is a top view of six dual-packet sheets depicted in FIG. 8, after their medial portions are pinched by a pinching mechanism to create the spokes-in-a-wheel arrangement.

As depicted in FIG. 9, following arranging the dual-packet sheets 10 front-to-back, fingers 61 and 61' of pincher mechanism 60 are brought close to one another, thus putting the medial portions 20 of adjacent ones of the sheets 10 in contact or at least close together. Because the condiment-filled portions 15 are thicker than the medial portions 20, the condiment-filled portions facing each other tend to "round out" into generally a circular shape, causing the packets 13 to tend to arrange themselves like spokes on a wheel. Thus, the assembly of the medial portions 20 is generally near the center of the arrangement, where the hub of the wheel would be.

Figure 10:
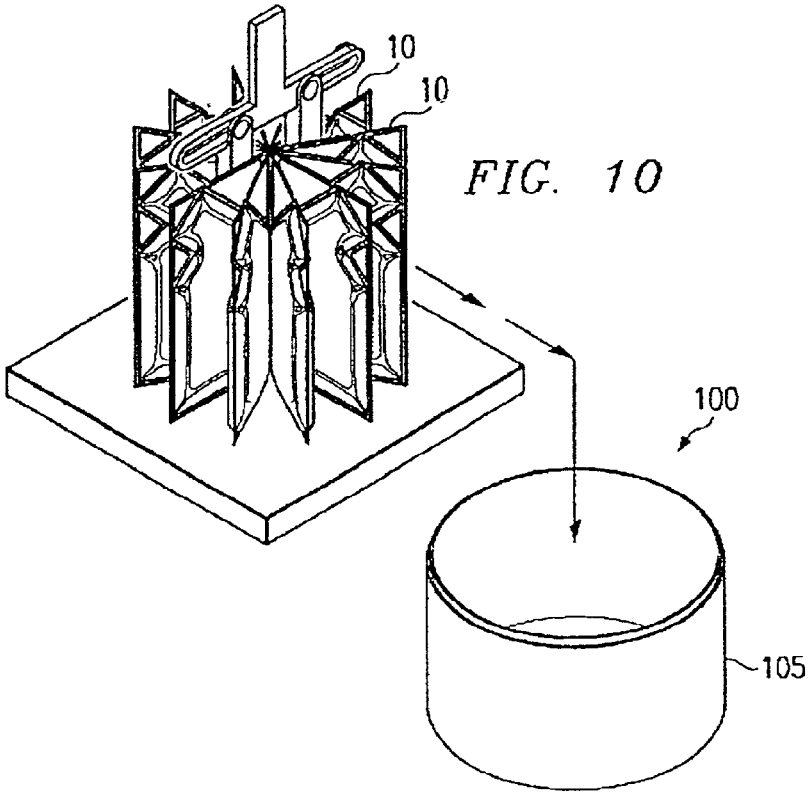
FIG. 10 is a somewhat schematic side view of six dual-packet sheets showing a preferred method for packing the sheets into an outer generally cylindrical container disposed below the elevation of the dual-packet sheets.
Figure 11:
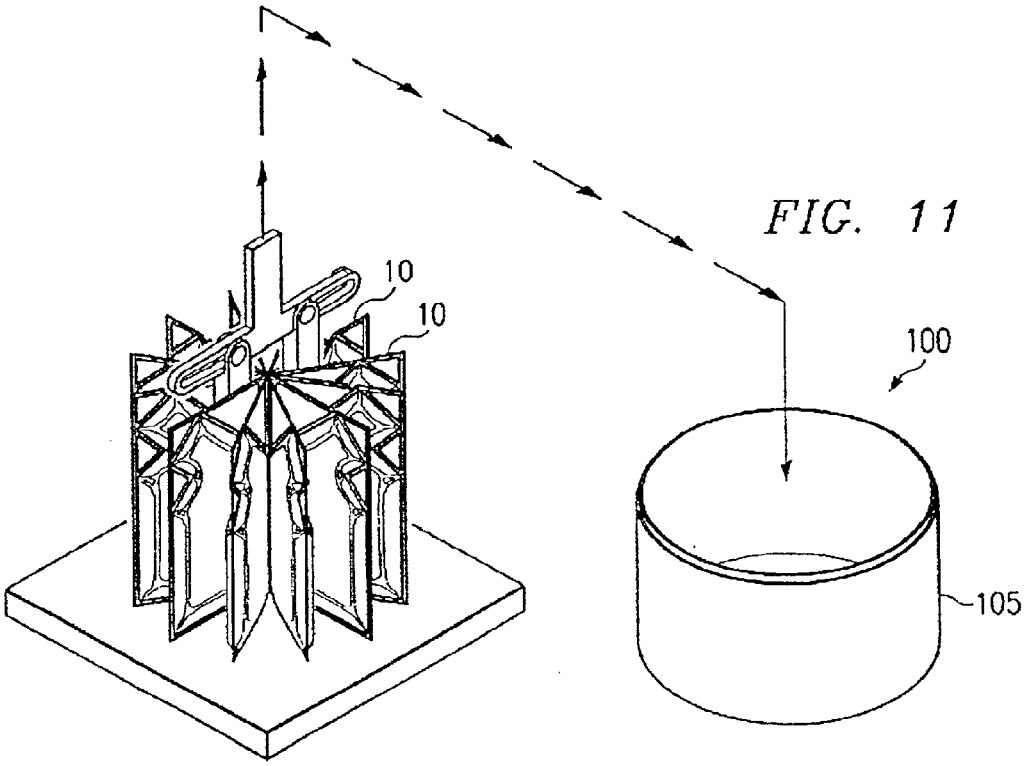
FIG. 11 is a somewhat schematic side view of six dual-packet sheets showing a preferred method for packing the sheets into an outer generally cylindrical container disposed at substantially the same elevation as the dual-packet sheets.

FIGS. 10 and 11 depict schematically two different methods of placing the pinched-together dual-packet sheets into an open, outer, generally in FIG. 10, open container 100 is placed below the elevation of the pinched arrangement of dual-packet sheets 10. After the fingers 61 and 61' of pincher mechanism 60 are brought together, the pinched-together arrangement of sheets 10 is preferably held together sufficiently snugly as to be able to suspend, or almost suspend, the pinched-together arrangement of the sheets 10. The mechanism 60, holding the pinched-together arrangement of the sheets 10, is moved horizontally above an open lower portion 105 of container 100, and then moved down to place the pinched-together assembly of the sheets 10 into the lower portion 105. If moved quickly enough, even if the mechanism 60 does not pinch quite hard enough to suspend the pinched-together assembly, the pinched-together assembly will be maintained in mid-air long enough to become positioned above container lower portion 105 before dropping into the container. The fingers 61 and 61' of the mechanism 60 are moved away from each other sufficiently to release the pinched-together assembly. This allows the mechanism to be moved up and away, back to a position above the next front-to-back arranged group of the sheets 10, i.e., arranged in the manner depicted in FIGS. 7 and 8 to repeat the process.

FIG. 11 depicts another example method for placing the pinched-together arrangement of sheets 10 into open container lower portion 105. In this example method, open container lower portion 105 is at approximately the same the elevation of the pinched arrangement of dual-packet sheets 10. After the fingers 61 and 61' of pincher mechanism 60 are brought together, the pinched-together arrangement of sheets 10 is held together sufficiently tightly as to be able to suspend the pinched-together arrangement of the sheets 10. Then, the mechanism 60 holding the pinched-together arrangement of the sheets 10 is first raised above the elevation of the top of the open container lower portion 105, then moved horizontally above the open container lower portion 105, and then moved down to place the pinched-together assembly of the sheets 10 into the container. The fingers 61 and 61' of the mechanism 60 are then moved away from each other sufficiently to release the pinched-together assembly, allowing the mechanism to be moved up and away, and back to a position above the front-to-back arranged group of the sheets 10, i.e., arranged in the manner depicted in FIGS. 7 and 8, to repeat the process.

Figure 12:
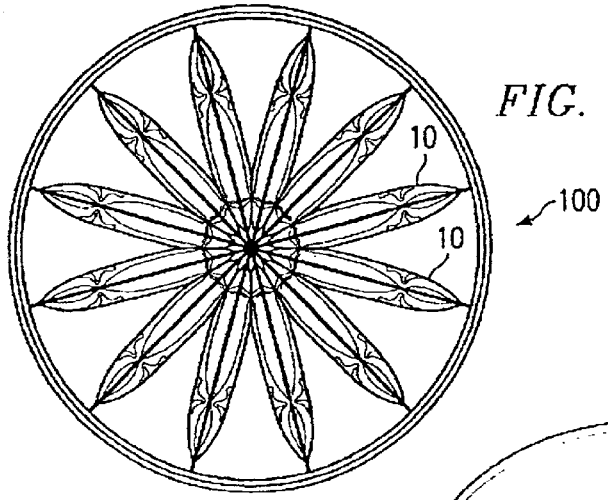
FIG. 12 is a top view of six dual-packet sheets disposed in the outer generally cylindrical container in the spokes-in-a-wheel arrangement.
Figure 13:
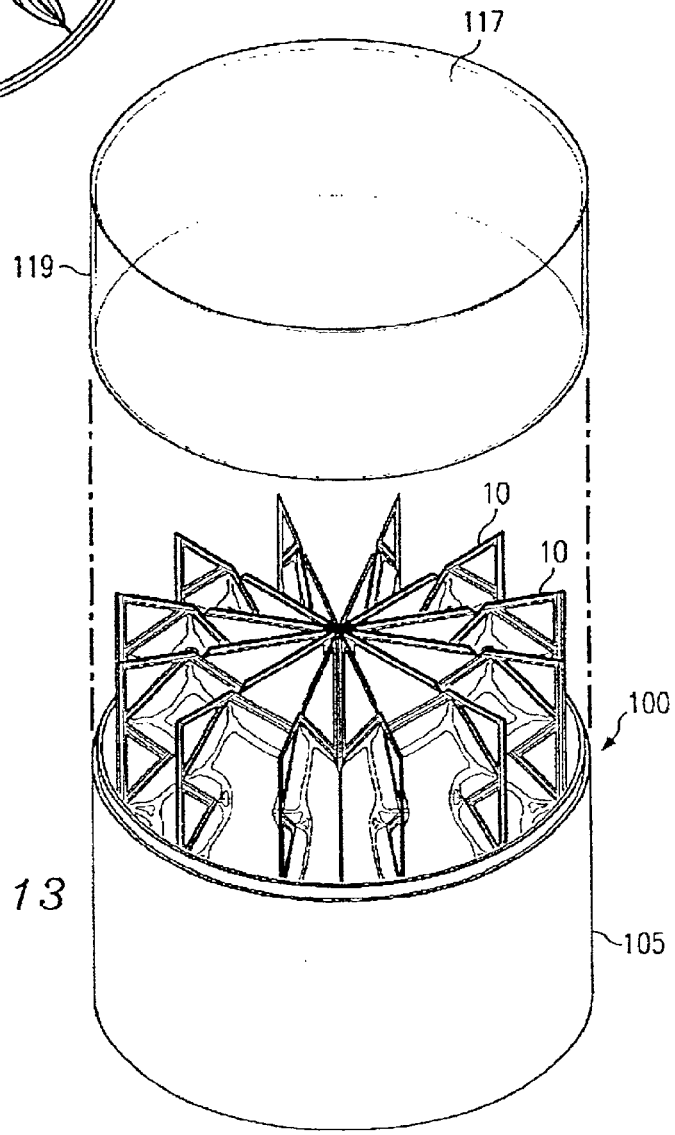
FIG. 13 is a perspective view of six dual-packet sheets disposed in the lower portion of an outer generally cylindrical container in the spokes-in-a-wheel arrangement, with the upper portion of the outer generally cylindrical container removed.

Once the pinched-together arrangement of the dual-packet sheets 10 is placed into container lower portion 105, the sides of the container lower portion 105 will maintain the spokes-on-a-wheel arrangement of the packets 13, without the need for fingers 61 and 61' to maintain medial portions 20 together. When fingers 61 and 61' are removed, some loosening and separation of the medial portions 20 from each other may occur, but the spokes-on-a-wheel arrangement of the packets 13 will still be substantially maintained by the sides of the container 105, as depicted in FIGS. 12 and 13.

Figure 14:
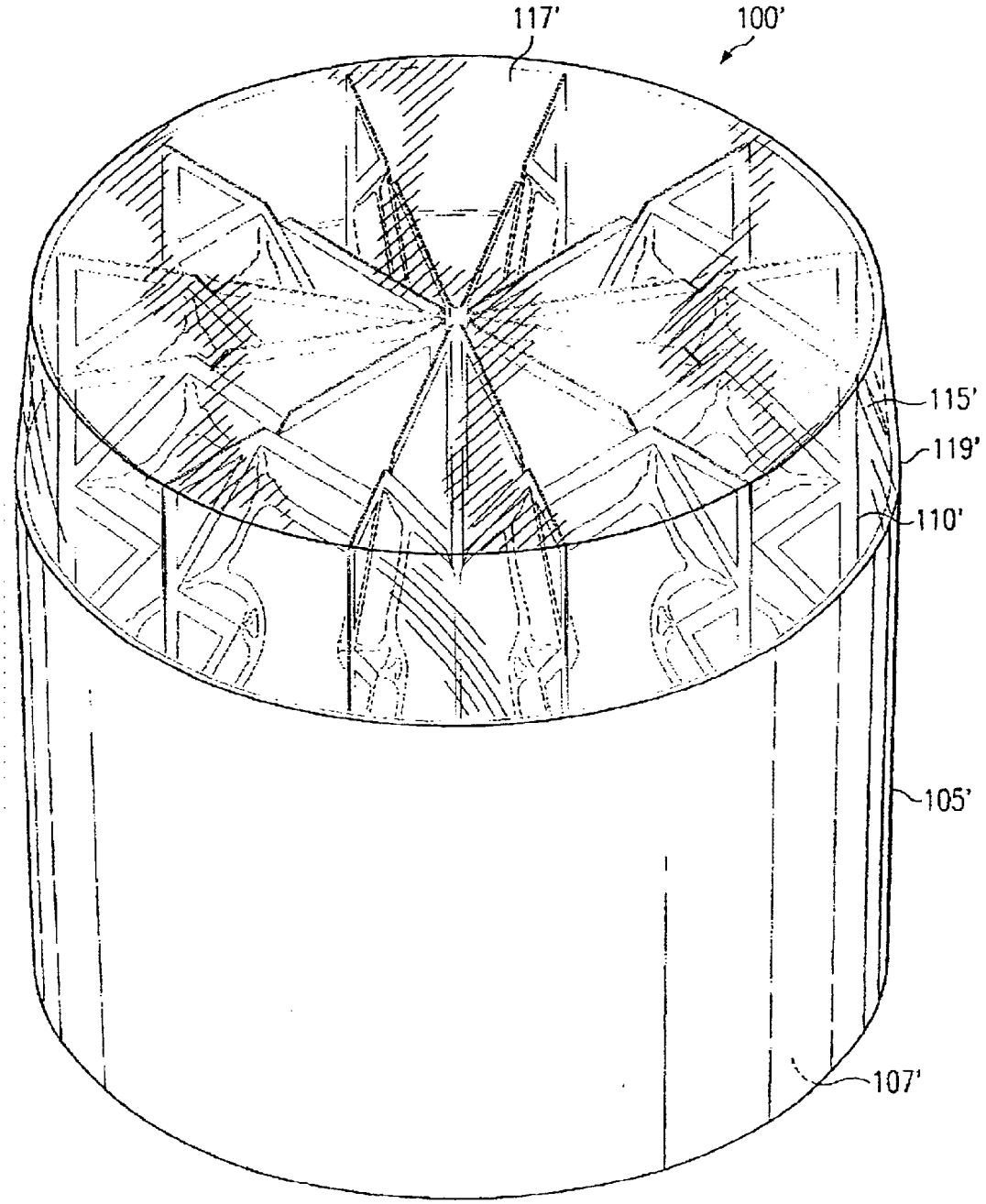
FIG. 14 is a perspective view of six dual-packet sheets disposed in a transparent outer generally cylindrical container in the spokes-in-a-wheel arrangement, with the upper generally transparent and slightly conical portion of the outer generally cylindrical container installed onto the lower, slightly conical portion.
Figure 15:
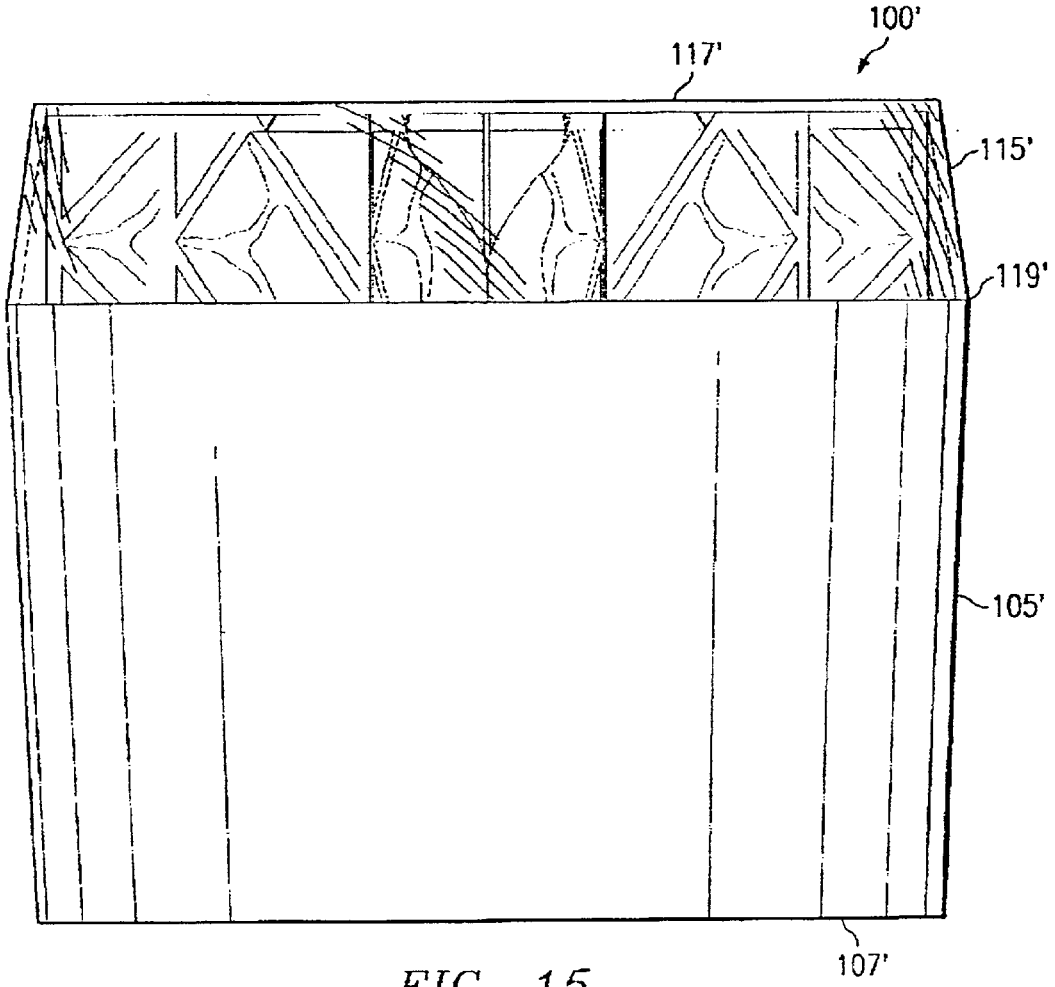
FIG. 15 is a side view of the six dual-packet sheets disposed in the transparent outer generally cylindrical container depicted in FIG. 14.
Figure 16:
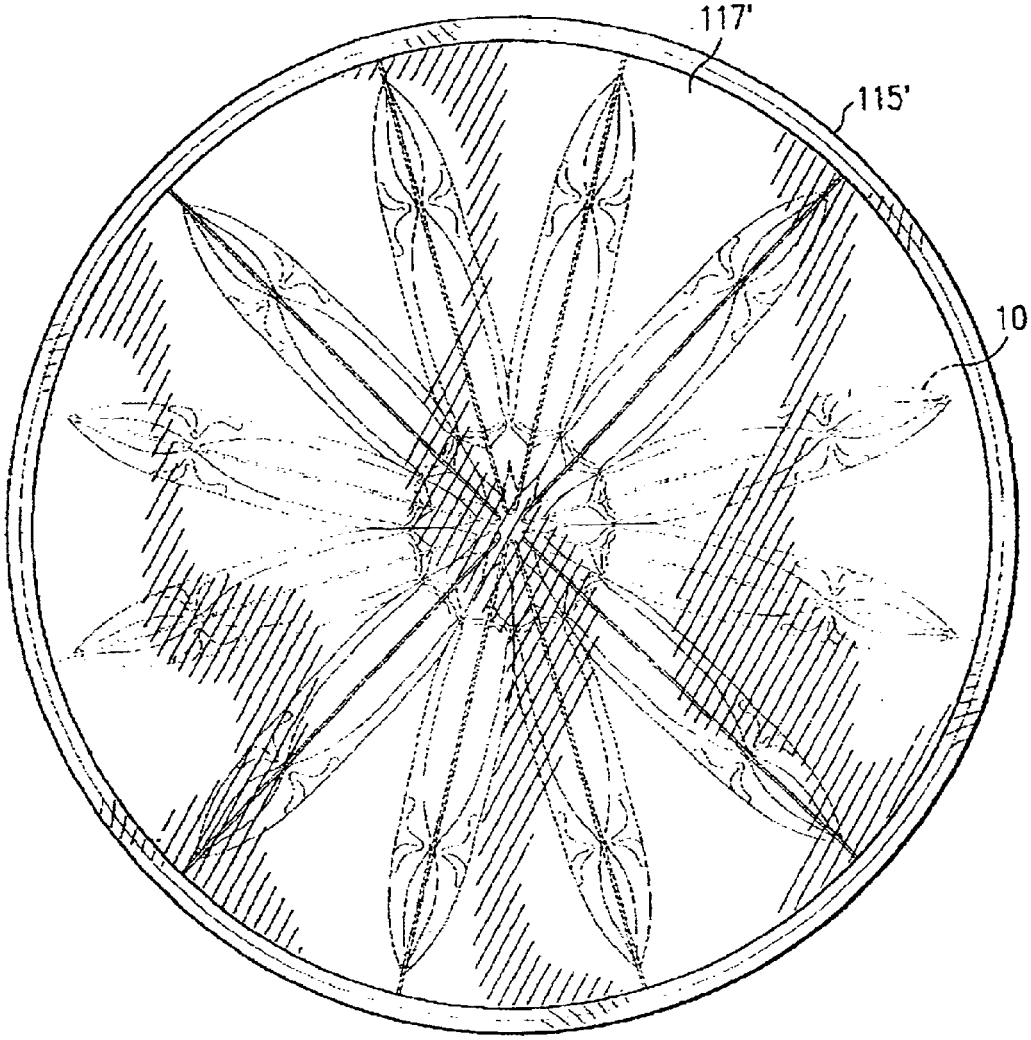
FIG. 16 is a top view of the six dual-packet sheets disposed in the transparent outer generally cylindrical container depicted in FIG. 14.

Referring now to FIGS. 14–16, an embodiment of the invention wherein container 100' has a lower portion 105' which is generally cylindrical and has a height less than the height of the spokes-on-a-wheel arrangement of packets 13. Also, although lower portion is described as being generally cylindrical, it is not required, or preferred, that the sides be exactly cylindrical. A 12-sided polygon may be employed, for example. Although the sides can be parallel, if desired, it is preferable for the bottom 107' of the lower portion 105' to have a smaller diameter than the upper rim 110', since such tends to make insertion of the pinched-together dual-packet sheets 10 easier and also desirably tends to "jam" the bottom of the dual-packet sheets 10 slightly into the lower portion 105' in an interference fit, to more securely maintain the spokes-on-a-wheel arrangement.

Preferably, as depicted in FIGS. 14–16, container 100' includes a generally cylindrical upper portion 115', covering the portion of the arrangement of dual-packet sheets 10 that is about the height of the upper rim 110' of lower portion 105'. Although upper portion 115' is described as being generally cylindrical, it is not required, or preferred, that the sides be exactly cylindrical. A 12-sided polygonal shape may be employed, for example, if desired. Although the sides can be parallell, if desired, it is preferable for the top 117' of the upper portion 115' to have a smaller diameter than the lower edge 119' that meets the upper edge 110' of lower portion 105', since such tends to "jam" the top corners of the dual-packet sheets 10 slightly, to more securely maintain the spokes-on-a-wheel arrangement in the container. Also, preferably one of either the upper 115' or lower 105' portions of container 100' includes a portion made from a material that is either transparent or translucent material, so that the spokes-on-a-wheel arrangement is visible from outside the container. Most preferably, a substantial portion of upper portion 115' is made from transparent or translucent plastic, so that the upper part of the spokes-on-a-wheel arrangement is visible through the sides of the upper portion, as well as through the top 117' of upper portion 115'.

It should be noted that, although it is preferred that the height of the upper rim 110' of lower portion 105' of container 100' be lower than the height of the spokes-on-a-wheel arrangement of packets 13, this is not required. Alternatively, the height of the rim 110' of lower portion 105' may be the same as, or even slightly less, than the height of the spokes-on-a-wheel arrangement of packets 13 and 13'. In such case, preferably, either lower portion 105' or the flat top 117' includes a translucent or transparent portion, so that the spokes on wheel arrangement is visible from outside the container.

Although the dual-packet 10 has been primarily discussed, it is to the understood that multi-packets greater than two may also be used, providing the spokes-on-a-wheel arrangement is maintained. Similarly, single packets, as were disclosed in FIGS. 5 and 6, may also be used, providing the packets are arranged in a spokes-on-a-wheel arrangement.

Although the invention has been described with reference to preferred embodiments of the invention, it is to be understood that the invention is by no means limited to these preferred embodiments. Rather, the scope of the invention is intended to be that defined by the claims below, and any equivalents thereof.

We claim:

1. A containered arrangement of condiment packets, comprising a container having a top, a bottom and a peripheral wall;

at least three dual-packet sheets within said container, each dual-packet sheet having a pair of individual nonporous packets each having a condiment-filled portion, said nonporous packets having a weakened tear-line in an unfilled medial portion of the sheet between them for manual separation of said nonporous packets for individual use, said dual-packet sheets being arranged with their condiment-filled portions in opposed front-to-back contact with their medial portions in parallel alignment and pinched closely together or in contact so that the condiment-filled portions are arranged generally like spokes on a wheel and having a size such that said nonporous packets are maintained in said approximately spokes-on-a-wheel arrangement by said outer peripheral wall.

2. The containered arrangement of condiment packets defined in claim 1, wherein said outer peripheral wall is generally cylindrical.

3. The containered arrangement of condiment packets defined in claim 2, wherein said top and bottom are generally circular.

4. The containered arrangement of condiment packets as defined in claim 1 wherein said outer peripheral wall has a transparent or translucent portion so that said generally spokes-on-a-wheel arrangement of said condiment packets is visible from outside said container.

5. The containered arrangement of condiment packets as defined in claim 1, wherein said arrangement of condiment packets has a height, said container having an upper approximately cylindrical portion and a lower approximately cylindrical portion, said lower approximately cylindrical portion having a height substantially less than said height of said arrangement of condiment packets so that a substantial portion of said condiment packets is retained in said upper approximately cylindrical portion.

6. The containered arrangement of condiment packets as defined in claim 5, wherein at least one of said upper and lower approximately cylindrical portions has a larger diameter at a point where said upper and lower approximately cylindrical portions meet than at its distal portion.

7. The containered arrangement of condiment packets as defined in claim 6, wherein both said upper and lower approximately cylindrical portions have a larger diameter at a point where said upper and lower approximately cylindrical portions meet than at distal portions thereof.

8. A containered arrangement of condiment packets, comprising a container having a top, a bottom and an outer peripheral wall, a plurality of nonporous packets arranged in said container generally like spokes on a wheel and being maintained in said generally spokes-on-a-wheel arrangement by said outer peripheral wall of said container; wherein said nonporous packets are disposed with two condiment-filled portions on the same sheet, with a medial portion of said sheet between them.

9. The containered arrangement of condiment packets defined in claim 8, wherein said outer peripheral wall is generally cylindrical.

10. The containered arrangement of condiment packets defined in claim 9, wherein said top and bottom are generally circular.

11. The containered arrangement of condiment packets as defined in claim 8, wherein said outer peripheral wall has a transparent or translucent portion so that said generally spokes-on-a-wheel arrangement of said condiment packets is visible from outside said container.

12. The containered arrangement of condiment packets as defined in claim 8, wherein said arrangement of condiment packets has a height, said container having an upper approximately cylindrical portion and a lower approximately cylindrical portion, said lower approximately cylindrical portion having a height substantially less than said height of said arrangement of condiment packets so that a substantial portion of said condiment packets is retained in said upper approximately cylindrical portion.

13. The containered arrangement of condiment packets as defined in claim 12, wherein at least one of said upper and lower approximately cylindrical portions has a larger diameter at a point where said upper and lower approximately cylindrical portions meet than at its distal portion.

14. The containered arrangement of condiment packets as defined in claim 13, wherein both said upper and lower approximately cylindrical portions have a larger diameter at a point where said upper and lower approximately cylindrical portions meet than at distal portions thereof.

* * * * *